US009108206B1

(12) United States Patent
Bredberg et al.

(10) Patent No.: US 9,108,206 B1
(45) Date of Patent: Aug. 18, 2015

(54) WATER CONTROL SYSTEM FOR SPRINKLER NOZZLE

(71) Applicants: Anthony J. Bredberg, Gig Harbor, WA (US); Al Davignon, Burien, WA (US)

(72) Inventors: Anthony J. Bredberg, Gig Harbor, WA (US); Al Davignon, Burien, WA (US)

( * ) Notice: Subject to any disclaimer, the term of this patent is extended or adjusted under 35 U.S.C. 154(b) by 0 days.

(21) Appl. No.: 14/206,602

(22) Filed: Mar. 12, 2014

Related U.S. Application Data

(60) Provisional application No. 61/801,867, filed on Mar. 15, 2013.

(51) Int. Cl.

| | |
|---|---|
| ***B05B 3/04*** | (2006.01) |
| ***B05B 1/14*** | (2006.01) |
| ***B05B 1/02*** | (2006.01) |
| ***B05B 1/30*** | (2006.01) |
| ***B05B 1/20*** | (2006.01) |
| *B05B 1/16* | (2006.01) |

(52) U.S. Cl.
CPC ..... *B05B 3/0427* (2013.01); *B05B 1/02* (2013.01); *B05B 1/14* (2013.01); *B05B 1/20* (2013.01); *B05B 1/3013* (2013.01); *B05B 1/3026* (2013.01); *B05B 3/0418* (2013.01); *B05B 3/0422* (2013.01); *B05B 1/1672* (2013.01)

(58) Field of Classification Search
CPC .. B05B 3/0422; B05B 3/0427; B05B 3/0428; B05B 1/14; B05B 1/02; B05B 1/3026; B05B 1/3013; B05B 1/1672; B05B 1/20
USPC ..... 239/237, 240, 241, 262, 246, 248, 551, 239/562, 563, 564, 566, 569
See application file for complete search history.

(56) References Cited

U.S. PATENT DOCUMENTS

| | | | |
|---|---|---|---|
| 129,125 | A | 7/1872 | Gibson |
| 820,789 | A | 5/1906 | Hutchins |
| 879,892 | A | 2/1908 | Packard |
| 1,181,145 | A | 5/1916 | Larson |
| 1,308,613 | A | 7/1919 | Anderson |
| 1,335,267 | A | 3/1920 | Ambrose |
| 1,400,533 | A | 12/1921 | Engel |
| 1,492,878 | A | 5/1924 | Eklundh |
| 1,593,918 | A | 7/1926 | Stanton |
| 1,618,538 | A | 2/1927 | Kittinger |
| 1,756,483 | A | 4/1930 | Estep |
| 1,766,514 | A | 6/1930 | Henry |
| 1,806,100 | A | 5/1931 | Thompson |
| 1,853,805 | A | 4/1932 | Elder |
| 1,881,409 | A | 10/1932 | Le Moon |
| 1,938,838 | A | 12/1933 | Jacobson |
| 1,964,225 | A | 6/1934 | Sumner |
| 1,968,396 | A | 7/1934 | Hollingworth |
| 2,002,178 | A | 5/1935 | Henry |
| 2,009,478 | A | 7/1935 | Coles et al. |
| 2,032,064 | A | 2/1936 | Meng |
| 2,047,348 | A | 7/1936 | Wilson |
| 2,090,284 | A | 8/1937 | Carlson |

(Continued)

*Primary Examiner* — Steven J Ganey
(74) *Attorney, Agent, or Firm* — R. Reams Goodloe, Jr.

(57) ABSTRACT

A sprinkler. A stationary base includes a turbine to drive an upper housing. A plurality of sprinkler nozzle assemblies mounted on the upper housing include low voltage solenoids that are energized via slip ring contacts, with a power discontinuous slip ring located on the base. When powered, the solenoids open to allow water to be directed from the nozzle in the sprinkler nozzle assembly. the nozzles are sized, shaped, and directed to apportion water as needed to provide average water quantities amongst parts of irregularly shaped parcels.

20 Claims, 11 Drawing Sheets

(56) References Cited

U.S. PATENT DOCUMENTS 2,221,878 A 11/1940 Nelson
2,305,210 A 12/1942 Wahlin
2,393,091 A 1/1946 Lacy-Mulhall
2,414,052 A 1/1947 Martin
2,560,662 A 1/1951 Rieger
2,571,763 A 10/1951 Robbins
2,595,114 A 4/1952 Wieseltier
2,600,987 A 6/1952 Gallice
2,601,559 A 6/1952 Riblet
2,619,388 A 11/1952 Wahlin
2,634,163 A 4/1953 Double
2,654,635 A 10/1953 Lazzarini
2,723,157 A 11/1955 Thompson
2,729,295 A 1/1956 Edwards
2,739,839 A 3/1956 Greener et al.
2,756,099 A 7/1956 Reynolds, Jr.
2,808,732 A 10/1957 Champion, Sr.
2,814,526 A 11/1957 Blair
2,895,681 A 7/1959 Kachergis
2,902,888 A 9/1959 Powischill et al.
2,909,325 A 10/1959 Hunter
2,999,643 A 9/1961 Kennedy
3,026,044 A 3/1962 Kennedy
3,035,777 A 5/1962 Bodell et al.
3,035,778 A 5/1962 Kimbro et al.
3,090,563 A 5/1963 Cheeseboro
3,095,148 A 6/1963 Smith
3,104,818 A 9/1963 Ballard et al.
3,107,056 A 10/1963 Hunter
3,111,268 A 11/1963 Butler
3,116,651 A 1/1964 Hardy
3,131,867 A 5/1964 Miller et al.
3,139,901 A 7/1964 Camp
3,141,909 A 7/1964 Mayo, Jr.
3,272,437 A 9/1966 Coson
3,321,138 A 5/1967 Curry
3,383,047 A 5/1968 Hauser
3,391,868 A 7/1968 Cooney
3,398,894 A 8/1968 D'Agaro
3,424,381 A 1/1969 Best
3,428,256 A 2/1969 Painter
3,451,623 A 6/1969 Dibrell
3,452,930 A 7/1969 Karbo
3,464,628 A 9/1969 Chow
3,508,711 A * 4/1970 Switall ..... 239/562
3,515,351 A 6/1970 Costa
3,528,093 A 9/1970 Eerkens
3,574,336 A 4/1971 Epple
3,578,248 A 5/1971 Congdon
3,580,506 A 5/1971 Costa
3,580,514 A 5/1971 Radecki
3,583,638 A 6/1971 Eby
3,625,429 A 12/1971 Turrell
3,645,451 A 2/1972 Hauser
3,648,928 A 3/1972 Lindgren
3,654,817 A 4/1972 Kane
3,703,993 A 11/1972 Schreiner
3,724,757 A 4/1973 Hunter
3,727,842 A 4/1973 Ertsgaard et al.
3,791,581 A 2/1974 Chow
3,791,585 A 2/1974 Warren
3,794,245 A 2/1974 Wilson
3,854,664 A 12/1974 Hunter
3,871,582 A 3/1975 Biddle
3,878,990 A 4/1975 Geraudie
3,884,416 A 5/1975 King
3,915,383 A 10/1975 King
3,921,191 A 11/1975 Merrin
3,921,910 A 11/1975 Hayes et al.
3,924,809 A 12/1975 Troup
3,952,954 A 4/1976 Taylor
3,960,327 A 6/1976 Olson
3,977,063 A 8/1976 Bruninga
4,002,295 A 1/1977 Drori
4,004,612 A 1/1977 Hummel, Jr. et al.
4,019,686 A 4/1977 Palma
4,026,471 A 5/1977 Hunter
4,055,205 A 10/1977 Withoff et al.
4,113,181 A 9/1978 Sheets
4,119,275 A 10/1978 Hunter
4,186,880 A 2/1980 Jacobi et al.
4,189,099 A 2/1980 Bruninga
4,198,000 A 4/1980 Hunter
4,198,001 A 4/1980 Rodriguez
4,201,334 A 5/1980 Janik
4,201,344 A 5/1980 Lichte
4,220,283 A 9/1980 Citron
4,245,786 A 1/1981 Abrahamsen et al.
4,253,608 A 3/1981 Hunter
4,265,403 A * 5/1981 Bonetti ..... 239/241
4,269,354 A 5/1981 DeWitt
4,272,024 A 6/1981 Kah, Jr.
4,277,029 A 7/1981 Rabitsch
4,281,793 A 8/1981 DeWitt
4,316,579 A 2/1982 Ray et al.
4,353,506 A 10/1982 Hayes
4,398,666 A 8/1983 Hunter
4,399,999 A 8/1983 Wold
4,417,691 A 11/1983 Lockwood
4,429,832 A 2/1984 Sheets
4,453,673 A 6/1984 Icenbice
4,462,545 A 7/1984 Lourenco
4,471,907 A 9/1984 Gerstmann
4,471,908 A 9/1984 Hunter
4,474,328 A 10/1984 Hale
4,496,104 A 1/1985 Ducasse
4,501,391 A 2/1985 Hunter
4,538,762 A 9/1985 Lemkin
4,540,125 A 9/1985 Gorney et al.
4,568,024 A 2/1986 Hunter
4,613,077 A 9/1986 Aronson
4,624,412 A 11/1986 Hunter
4,625,914 A 12/1986 Sexton et al.
4,637,549 A 1/1987 Schwartzman
4,646,224 A 2/1987 Ransburg et al.
4,648,558 A 3/1987 Rabitsch
4,681,259 A 7/1987 Troup
4,681,260 A 7/1987 Cochran
4,687,137 A * 8/1987 Boger et al. ..... 239/566
4,718,605 A 1/1988 Hunter
4,739,934 A 4/1988 Gewelber
4,739,997 A 4/1988 Smetana
4,763,838 A 8/1988 Holcomb
4,766,709 A 8/1988 Galbraith
4,773,595 A 9/1988 Livne
4,781,327 A 11/1988 Lawson et al.
4,796,809 A 1/1989 Hunter
4,796,811 A 1/1989 Davisson
4,819,875 A 4/1989 Beal
4,834,289 A 5/1989 Hunter
4,836,449 A 6/1989 Hunter
4,836,450 A 6/1989 Hunter
4,836,458 A 6/1989 Cavagna
4,867,379 A 9/1989 Hunter
4,892,252 A 1/1990 Bruninga
4,907,742 A 3/1990 Whitehead et al.
4,913,351 A 4/1990 Costa
4,961,534 A 10/1990 Tyler et al.
4,984,740 A 1/1991 Hodge
5,009,368 A 4/1991 Streck et al.
5,031,840 A 7/1991 Grundy et al.
5,039,013 A 8/1991 Sawade et al.
5,056,699 A 10/1991 Newbold et al.
5,058,806 A 10/1991 Rupar
RE33,823 E 2/1992 Nelson et al.
5,123,597 A 6/1992 Bendall
5,154,348 A 10/1992 Ratnik et al.
5,248,093 A 9/1993 Pleasants
5,248,095 A 9/1993 Rankin et al.
5,267,689 A 12/1993 Forer
5,280,854 A 1/1994 Das
5,297,607 A 3/1994 Beauchamp
5,328,178 A 7/1994 Nies
5,333,785 A 8/1994 Dodds et al.

(56) References Cited

U.S. PATENT DOCUMENTS

| | | | |
|---|---|---|---|
| 5,366,157 | A | 11/1994 | Pleasants |
| 5,370,311 | A | 12/1994 | Chen |
| 5,375,768 | A | 12/1994 | Clark |
| 5,423,486 | A | 6/1995 | Hunter |
| 5,598,977 | A | 2/1997 | Lemme |
| 5,636,793 | A | 6/1997 | Gurevitch |
| 5,647,541 | A | 7/1997 | Nelson |
| 5,710,887 | A | 1/1998 | Chelliah et al. |
| 5,711,486 | A | 1/1998 | Clark et al. |
| 5,774,870 | A | 6/1998 | Storey |
| 5,845,849 | A | 12/1998 | Mitzlaff |
| 6,079,637 | A | 6/2000 | Ohayon |
| 6,158,675 | A | 12/2000 | Ogi |
| 6,241,158 | B1 | 6/2001 | Clark et al. |
| 6,332,581 | B1 | 12/2001 | Chin et al. |
| 6,402,048 | B1 | 6/2002 | Collins |
| 6,491,235 | B1 | 12/2002 | Scott et al. |
| 6,494,385 | B1 | 12/2002 | Chen |
| 6,651,905 | B2 | 11/2003 | Sesser et al. |
| 6,688,539 | B2 | 2/2004 | Vander Griend |
| 6,695,223 | B2 | 2/2004 | Beutler et al. |
| 6,732,950 | B2 | 5/2004 | Ingham, Jr. et al. |
| 6,732,952 | B2 | 5/2004 | Kah, Jr. |
| 6,736,332 | B2 | 5/2004 | Sesser et al. |
| 6,814,304 | B2 | 11/2004 | Onofrio |
| 6,817,543 | B2 | 11/2004 | Clark |
| 6,827,291 | B2 | 12/2004 | Townsend |
| 6,834,814 | B1 | 12/2004 | Beckman |
| 6,834,816 | B2 | 12/2004 | Kah, Jr. |
| 6,837,448 | B2 | 1/2005 | Han et al. |
| 6,921,029 | B2 | 7/2005 | Lockwood |
| 7,090,146 | B1 | 8/2006 | Ericksen et al. |
| 7,631,813 | B1 | 12/2009 | Lichte et al. |
| 7,828,230 | B1 | 11/2010 | Anuskiewicz et al. |
| 8,074,897 | B2 | 12/2011 | Hunnicutt et al. |
| 2005/0194465 | A1 | 9/2005 | Wang |

* cited by examiner

WATER CONTROL SYSTEM FOR SPRINKLER NOZZLE

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

RELATED PATENT APPLICATIONS

This application claims priority from prior U.S. Provisional Patent Application Ser. No. 61/801,867, filed Mar. 15, 2013, entitled WATER CONTROL SYSTEM FOR SPRINKLER NOZZLE, the disclosure of which is incorporated herein in its entirety, including the specification, drawing, and claims, by this reference.

TECHNICAL FIELD

This invention relates to lawn sprinklers, and more particularly, to lawn sprinklers adapted for use in watering a water receiving area having a non-uniform shape.

BACKGROUND

Water sprinklers of various designs have been utilized for many years. However, many of the currently utilized sprinklers are designed to provide water over a circular area that is of relatively uniform diameter. A few designs have the ability to water over selected receiving areas that are shaped as relatively circular arc portions. One of my prior patents, namely U.S. Pat. No. 7,988,071, issued Aug. 2, 2011, for a LAWN SPRINKLER, provides designs for attacking some aspects of the problem of watering irregularly shaped parcels. Also, my U.S. Provisional Patent Application filed Mar. 15, 2013, as Ser. No. 61/799,760, addresses such issues. The disclosure of each of those prior cases is incorporated herein in their entirety by this reference, Significant amounts of water are wasted due to the inability of the general public to obtain and install lawn sprinklers that are capable of watering non-uniform or irregularly shaped areas specifically and exclusively where water is needed, rather than applying a water stream relatively indiscriminately over an area that may include features where water is not required, such as driveways or sidewalks.

Since water is increasingly scarce and/or increasingly costly in many locales (whether as a result of increased fees from the utility provider, or as a result of energy costs for pumping, or otherwise) there remains a need for a law sprinkler apparatus that can reliably provide the needed water over the required area, while minimizing or eliminating the application of water to adjacent areas which do not require the application of water.

Thus, there remains an unmet need for an improved lawn sprinkler with suitable features and mechanical workings that would direct available water to those areas needing water, while avoiding application of water to those areas which do not require watering.

SUMMARY

A lawn sprinkler has now been developed with water distribution nozzles that are provided with water via valves that are opened and closed according to a predefined pattern. By using such a lawn sprinkler apparatus, the volume of water actually applied to a particular portion of a lawn is appropriate for the size and shape of the area that is watered, even when the water is applied over an area having a non-circular shape or irregular geometric pattern.

In one embodiment, the sprinkler apparatus includes a base configured to confiningly receive a pressurized water flow, and a sprinkler nozzle assembly coupled to the base for rotating movement with respect to the base. A turbine drive mechanism is coupled to an upper housing on which a plurality of sprinkler nozzle assemblies are affixed. The drive mechanism includes water driven impeller and a gear train adapted for operatively driving the upper housing, and associated sprinkler nozzle assemblies, in rotary movement.

One or more, and in various embodiments, a plurality of solenoid operated water flow valves are provided to regulate the water flow outward from the nozzle in a predetermined pattern consistent with the size and shape of the area to be watered. A slip ring system for supply of electricity to the solenoid is provided. In an embodiment, water flow valves are provided in a normally closed position, wherein electrical energy urges the valve toward an open position. Thus, a spring in the solenoid urges the valve toward a closed position, by compression of the spring, unless the solenoid is energized.

A water outlet nozzle is provided to deliver water in a given direction, generally in a preselected area pattern. In an embodiment, the solenoid mechanism may be operative to open and close the water flow valves in response to the slip ring mechanism, so that the water outlet nozzles only discharge water in the desired amounts in a selected direction.

The foregoing briefly describes a lawn sprinkler apparatus having valves to regulate the flow of water to provide a substantially uniform quantity of water per unit area of lawn, even in non-circular or irregular geometric shapes. However, the developments described herein will be more readily understood upon consideration of the following detailed description, taken in conjunction with careful examination of the accompanying figures of the drawing.

BRIEF DESCRIPTION OF DRAWING

In order to enable the reader to attain a more complete appreciation of the developments described herein, such developments will be described by way of exemplary embodiments, illustrated in the accompanying drawing figures in which like reference numerals denote like elements, with respect to which mention thereof may not be repeated when using the same numbers or letters with only differing subscripts, for identical but repeated parts, or for very similar parts with only minor differences, which usage will be evident in the context of the specification and usage in these drawing figures, and in which:

FIG. 10 shows the use of a large diameter nozzle in a sprinkler nozzle assembly, with the solenoid energized so that water may be discharged from the nozzle.

FIG. 11 provides the use of a medium diameter nozzle in a sprinkler nozzle assembly, with the solenoid energized so that water may be discharged from the nozzle.

FIG. 12 provides the use of a small diameter nozzle in a sprinkler nozzle assembly, with the solenoid energized so that water may be discharged from the nozzle.

Figure 1:
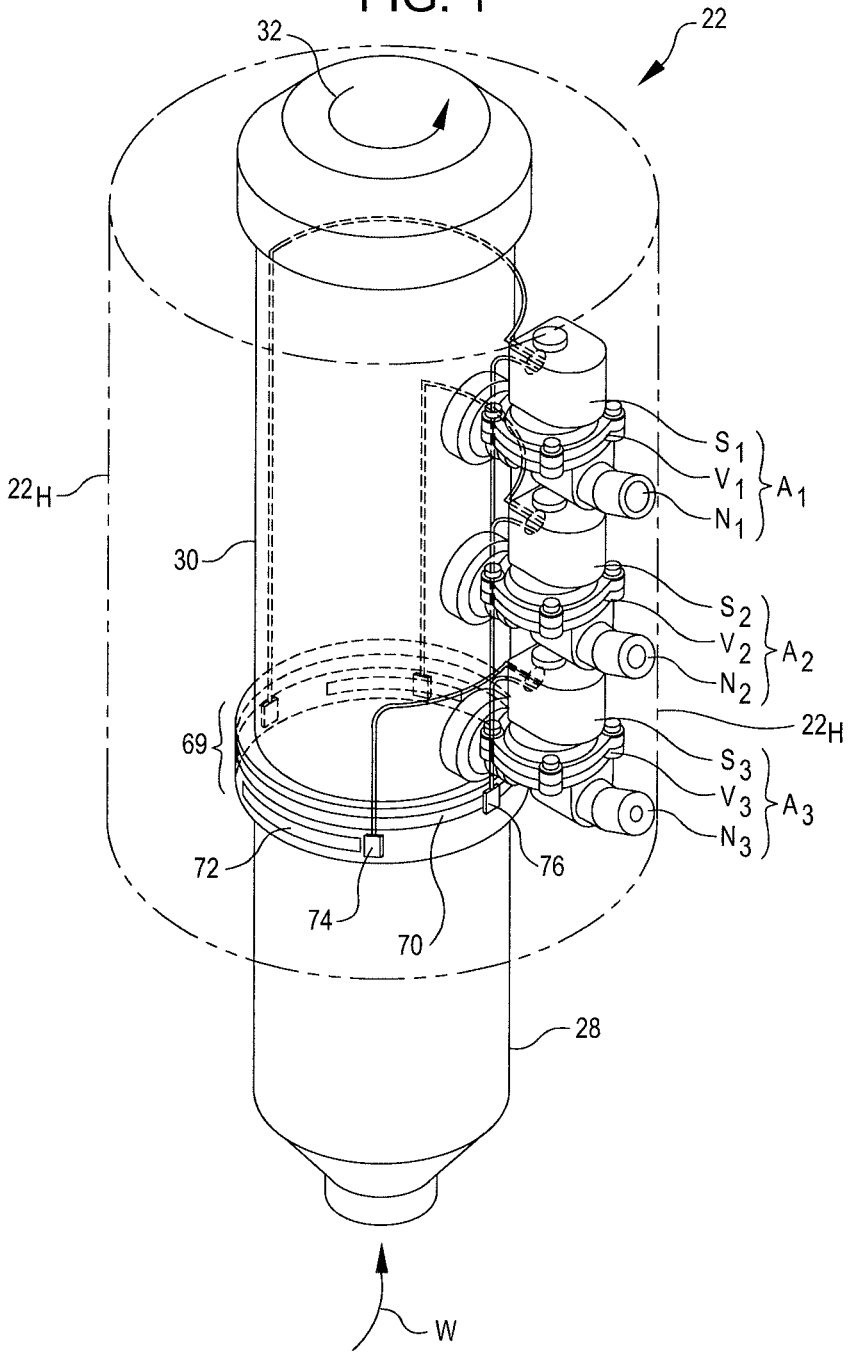
FIG. 1 provides a perspective view of an embodiment for a lawn sprinkler for watering an irregular shaped lawn area, showing a plurality of nozzles, with nozzles having various diameter outlets, and showing use of a slip ring mechanism to energize and de-energize solenoid valves in an driven upper housing in which the plurality of nozzles are mounted.

The foregoing figures, being merely exemplary, contain various elements that may be present or omitted from actual apparatus that may be constructed to provide various embodiments for covers for rotating sprinklers, or to various configurations for operation thereof, or to methods for use thereof. An attempt has been made to draw the figures in a way that illustrates at least those elements that are significant for an understanding of the components of an embodiment for useful low voltage slip ring energized multi-solenoid sprinklers as taught herein. However, various other elements for such apparatus, or for installation and use of the same, may be utilized in order to provide useful embodiments for covers for sprinklers, particularly for use on irregularly shaped water receiving parcels, according to the concepts disclosed herein.

In the various figures of the drawing, like features may be illustrated with the same reference numerals, without further mention thereof. Further, the foregoing figures are merely exemplary, and may contain various elements that might be present or omitted from actual implementations of various embodiments depending upon the circumstances. The features as illustrated provide an exemplary embodiment for a sprinkler that may control the amount of water provided to specific locations of a parcel of land, and to water volume applied along a radial length, at the same time, through selection of nozzle characteristics, and to regulation of the amount of water provided to such nozzles through a slip ring energized, solenoid controlled valve. An attempt has been made to draw the figures in a way that illustrates at least those elements that are significant for an understanding of the various embodiments and aspects of the invention. However, various other elements of a lawn sprinkler with valve and sprinkler assembly designs, or gear train designs, especially as applied for different variations of the functional components illustrated, as well as different embodiments such as a shape of components or final design of various elements, may be utilized in order to provide a useful, reliable, lawn sprinkler design constructed according to the designs described herein, that may be useful for minimizing waste of water, and in normalizing the application rate of water (on an irrigation volume per square foot or similar basis) over areas of a lawn, particularly for irregular or other non-circular lawn shapes.

DETAILED DESCRIPTION

Figure 2:
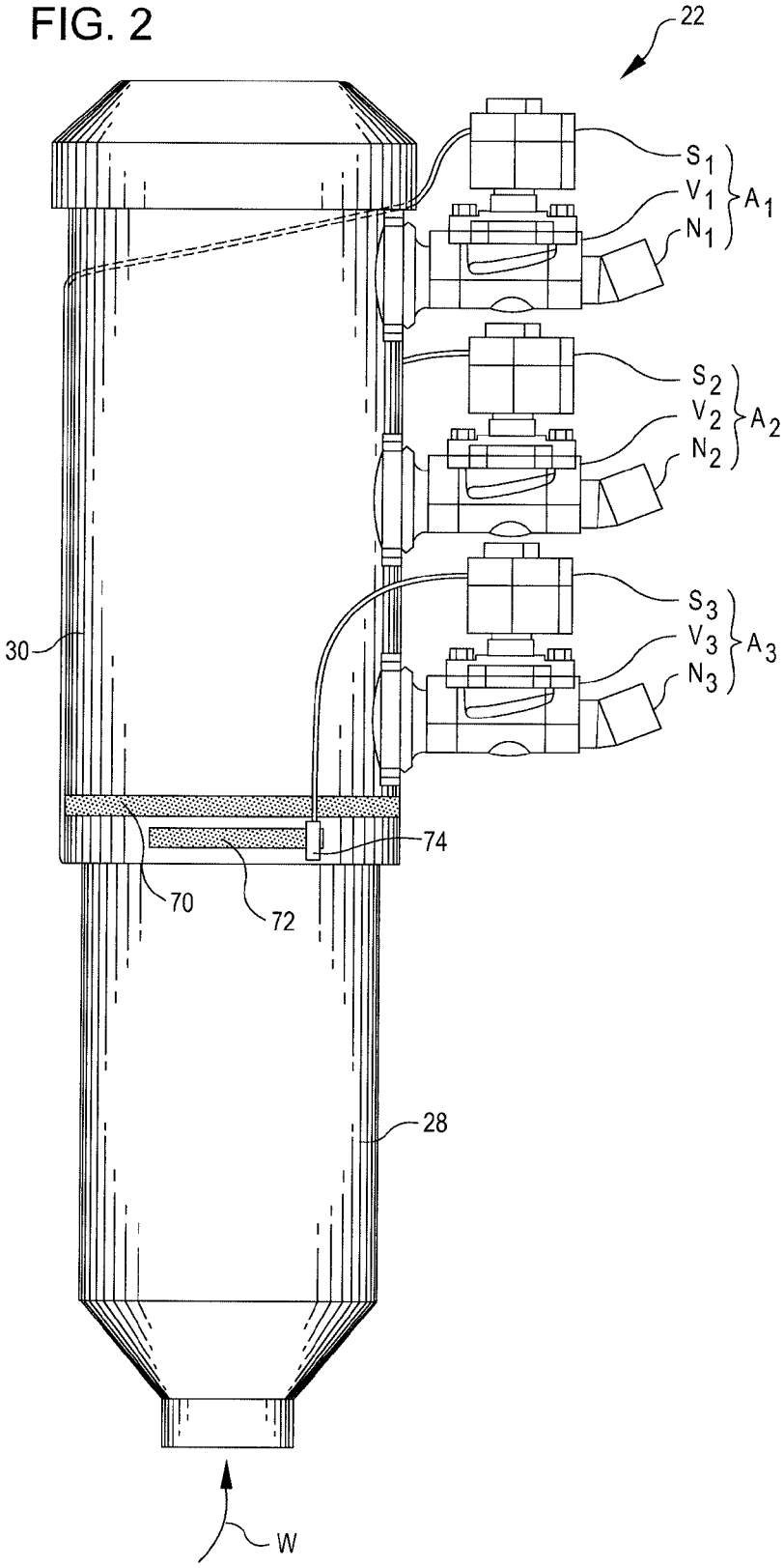
FIG. 2 provides a vertical elevation view of an embodiment of a lawn sprinkler for watering an irregular shaped lawn area, showing a rotating upper housing with stationary base, wherein the sprinkler nozzle assemblies include nozzles and solenoid valves, wherein the solenoid valves are programmed by the slip ring locations to open and close valves, which in turn allocate water to selected nozzles.
Figure 13:
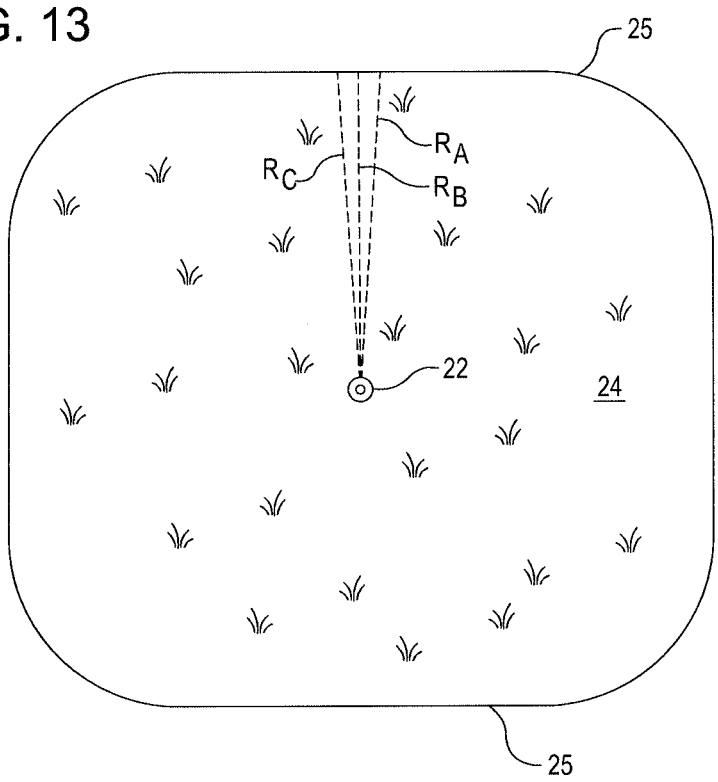
FIG. 13 is a plan view of a non-circular lawn area that is to be watered, preferably with a relatively uniform volume of water per square foot of lawn wherever located, via a rotating sprinkler that provides water substantially along vectors of differing radial lengths from the sprinkler, showing watering along short vectors, where the amount of water delivered along the radial vector will be decreased.
Figure 14:
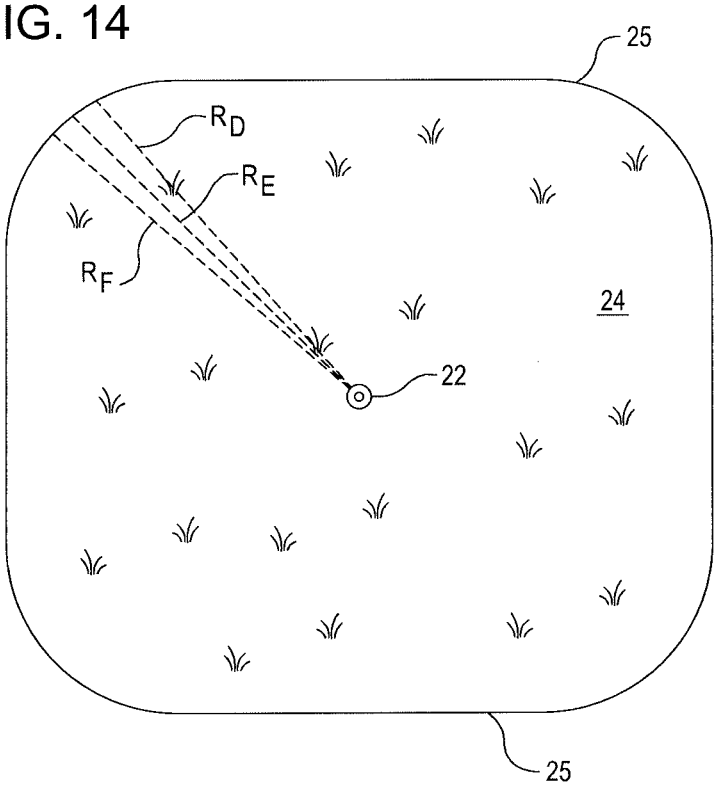
FIG. 14 is a plan view of the non-circular lawn area just illustrated in FIG. 13 above, now showing watering along longer radial lengths from the rotating sprinkler, which as described herein will preferably be provided with a substantially uniform volume of water per square foot of lawn, wherever located, from the sprinkler nozzle assemblies provided on the sprinkler.

Attention is directed to FIG. 1 of the drawing, which provides a perspective view of an exemplary sprinkler 22 for watering a non-circular, irregular shaped lawn, such as lawns illustrated in FIGS. 13 and 14. In FIGS. 13, and 14, it can be seen that sprinkler 22 is set up to water non-circular parcel of land 24. In such parcel 22, it can be seen that when sprinkler 22 is watering along relatively short radials $R_A$, $R_B$, and $R_C$, the amount of water is needed along such radial lengths per unit of time is not as much as would be required for the same unit of time along the longer radial lengths $R_D$, $R_E$, and $R_F$ as shown in FIG. 14. To address this problem, we have developed a novel sprinkler 22 in which a base 28 is provided having an upper housing 30 rotatably attached thereto. In an embodiment, the upper housing 30 may be set up mechanically to rotate in a selected direction as indicated by reference arrow 32 in FIG. 1. As upper housing 30 rotates, the water flow rate 34 from nozzles N (see FIG. 2) starts or stops, or stays constantly on, or stays off, as required in order to regulate, limit, or prevent water from being delivered nozzles $N_1$, $N_2$, or $N_3$. For the watering of relatively short radials $R_A$, $R_B$, and $R_C$ as shown in FIG. 13, the amount of water provided through nozzles N may be reduced, for example by providing water to two rather than three nozzles N, as noted in FIG. 8, during the time that the group of nozzles N rotates through such angular direction(s). For the watering of relatively long radial lengths $R_D$, $R_E$, and $R_F$, the water flow rate 34 increases, by selection of nozzles N with larger diameter D openings, or by using three of three nozzles N rather than two, in order to provide more water to via nozzles N for watering along the relatively longer radials $R_D$, $R_E$, and $R_F$. Novel construction of sprinkler 22, which enables such metered delivery of water to a parcel of land 24 will be further described below.

Attention is directed to FIG. 1, which shows a vertical perspective view for an embodiment of sprinkler 22. The sprinkler 22 includes a base 28, which is stationary relative to upper housing 30, which rotates. Note, however, as mentioned below and shown in FIG. 18, an apparatus such as sprinkler 22 may be fitted with an outer housing $\mathbf{22}_H$ surrounding upper housing 30, to hide the sprinkler nozzle assemblies, including solenoids $S_1$, $S_2$ and $S_3$, from view.

Figure 3:
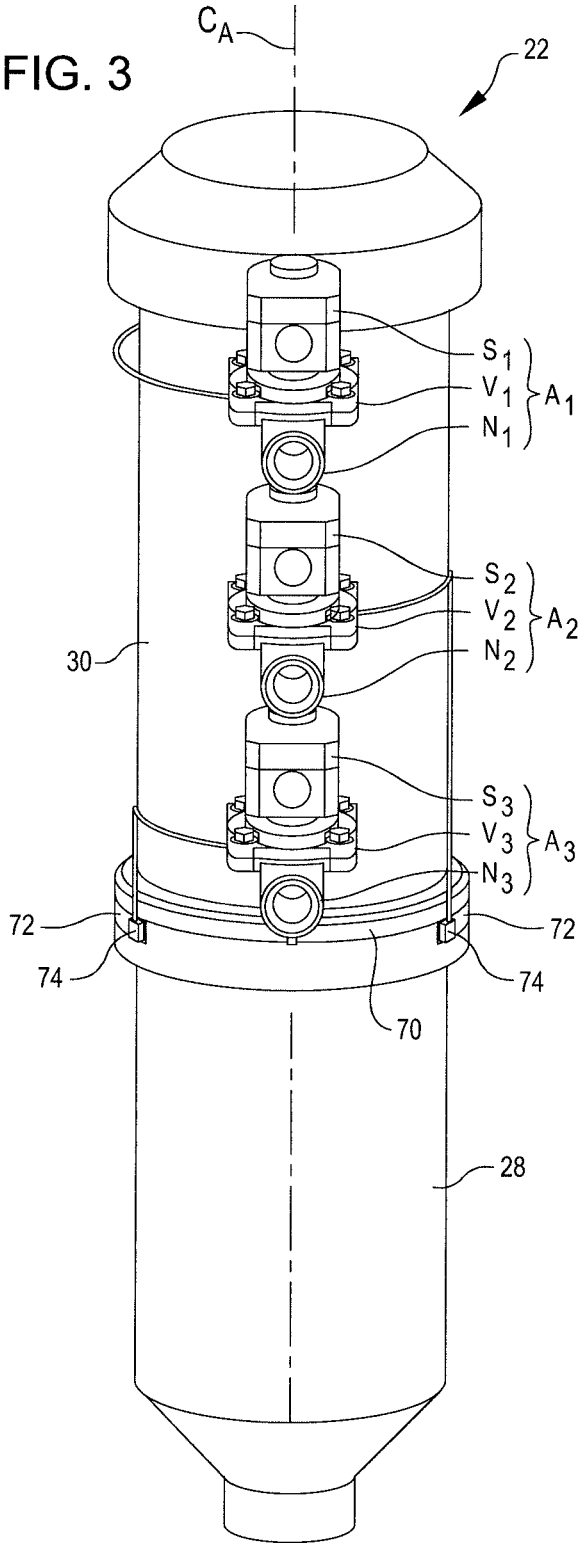
FIG. 3 provides a perspective view of an embodiment for a sprinkler, wherein a slip ring energizes and de-energizes an electrical circuit for opening and closing valves in a sprinkler nozzle assembly, and wherein the sprinkler nozzle assembly is mounted on upper housing of a sprinkler for rotary movement.
Figure 4:
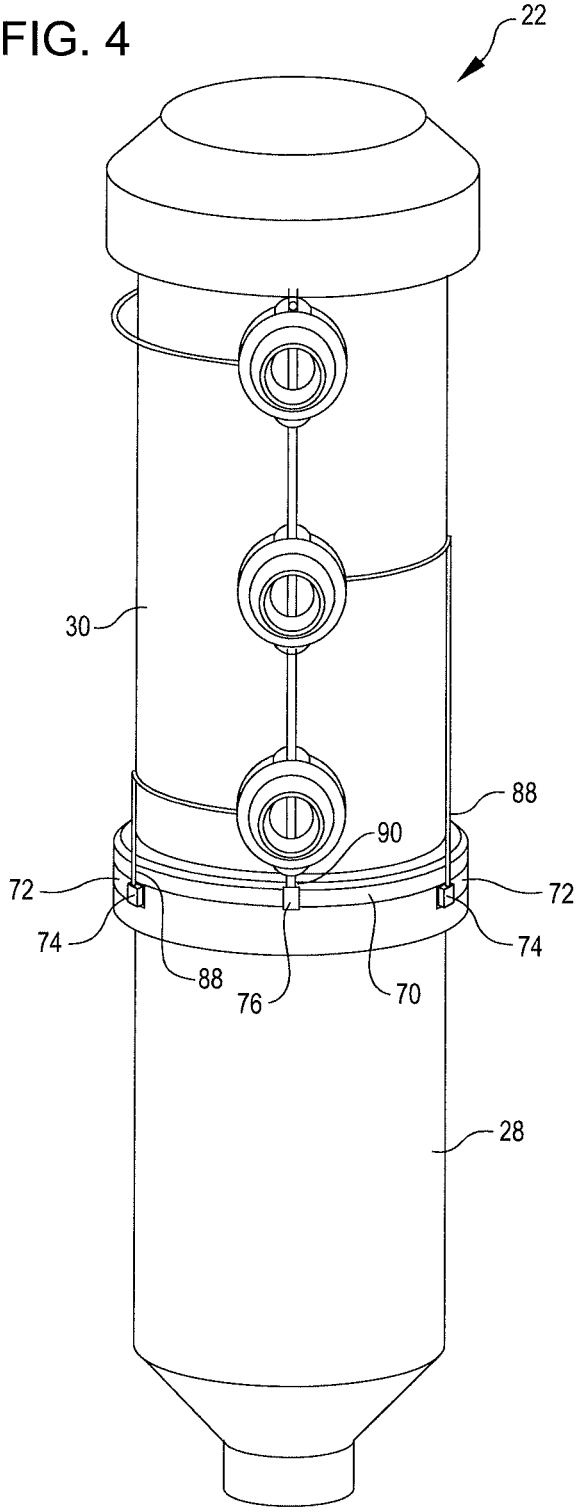
FIG. 4 provides a partial perspective view of an embodiment for a sprinkler, with a vertical section taken between the solenoid valves and the joint between the sprinkler nozzle assembly and the upper housing, showing wiring from the slip ring to the area of each solenoid valve, for connection to the solenoid valves.
Figure 5:
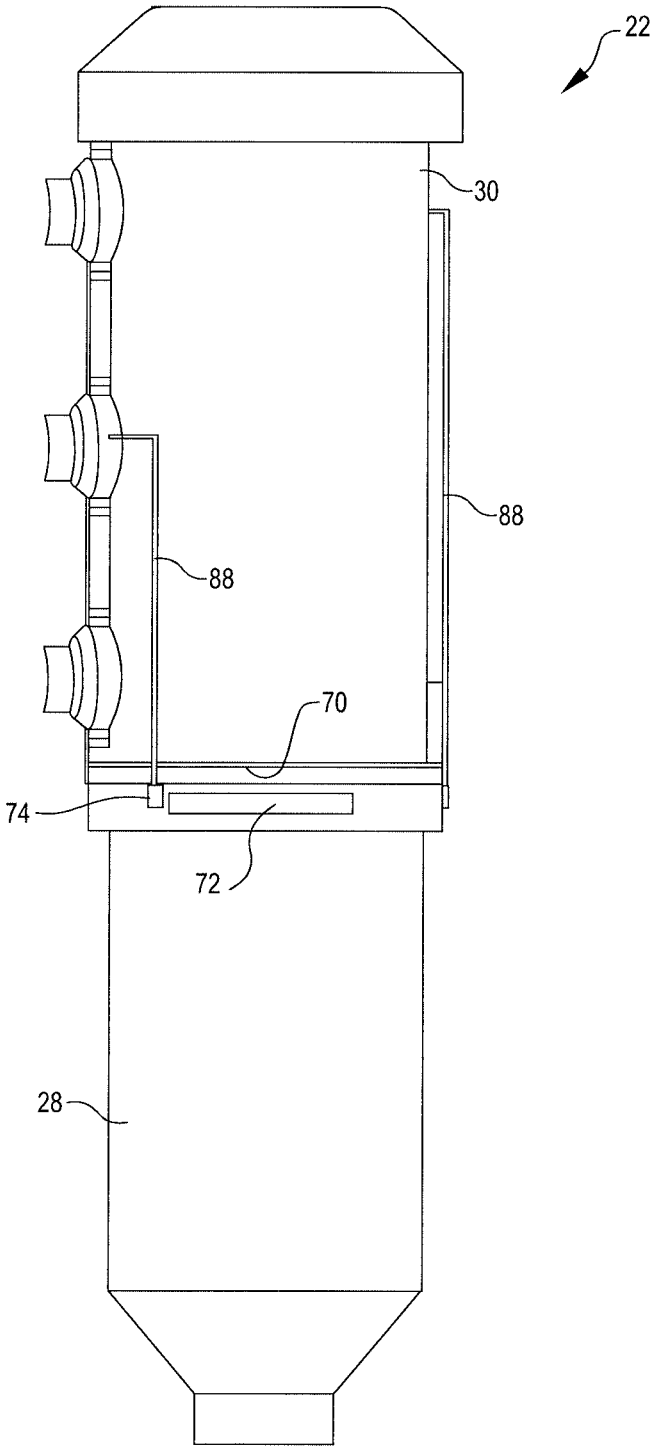
FIG. 5 provides a side elevation view of the partial perspective view taken at the same vertical cross section, again showing the use of a slip ring arrangement for energizing and de-energizing a solenoid for opening and closing a valve in a sprinkler nozzle assembly.

Returning now to FIG. 1, a rotatable upper housing 30 is mounted on sprinkler base 28. At least one sprinkler nozzle assembly $A_1$ is secured to and rotatable with the upper housing 30. Generally, a sprinkler nozzle assembly $A_1$ includes the solenoid S1, the related valve $V_1$, and the output nozzle, $N_1$. In most embodiments, a plurality of nozzle assemblies such as nozzle assemblies $A_1$, $A_2$, and $A_3$, as shown in FIG. 1, will be provided. In various embodiments, nozzle assemblies may be provided in groups. For example, nozzle assemblies $A_1$, $A_2$, and $A_3$ constitute a first or A group of nozzle assemblies. In an embodiment a group may arranged in a vertically aligned fashion, as shown in FIG. 3, where $A_1$, $A_2$, and $A_3$ are located one above the other, along vertical centerline $C_A$. In various embodiments, water may enter at the bottom as indicated by reference arrow W.

Figure 7:
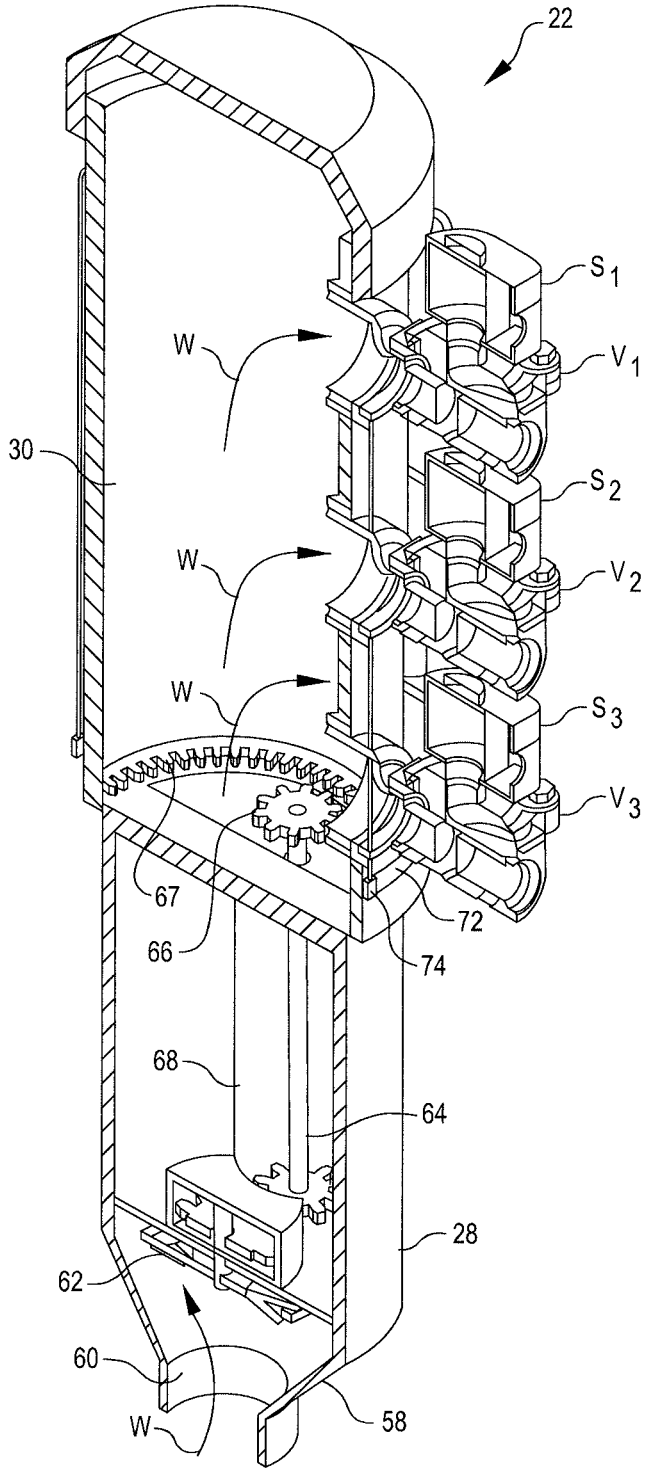
FIG. 7 provides a perspective of a vertical cross-sectional view of an embodiment for a lawn sprinkler for watering an irregular shaped lawn area, showing a plurality of sprinkler nozzle assemblies mounted on a upper housing, and an annular gear for driving the upper housing, which annular gear is driven by a pinion gear, which in turn is driven by a shaft and gear train driven by a water turbine mounted at the inlet to the sprinkler.

Attention is directed to FIG. 7, which shows a vertical cross sectional view of an embodiment for a sprinkler 22. Pressurized water W is received at inlet 56 of lower housing 58 of base 28. The lower housing 58 has an inner sidewall 60 that contains pressurized water W. The base 28 has a water W driven inlet turbine 62 operably fixed therein. A gear train 64 having an output gear 66 responsive to the inlet turbine 62 is provided. In an embodiment, output gear 66 is a pinion gear that drives annular gear 67 in upper housing 30. In an embodiment, portions of the gear train 64 may be sheltered from flow of water W by a gear housing 68.

Figure 6:
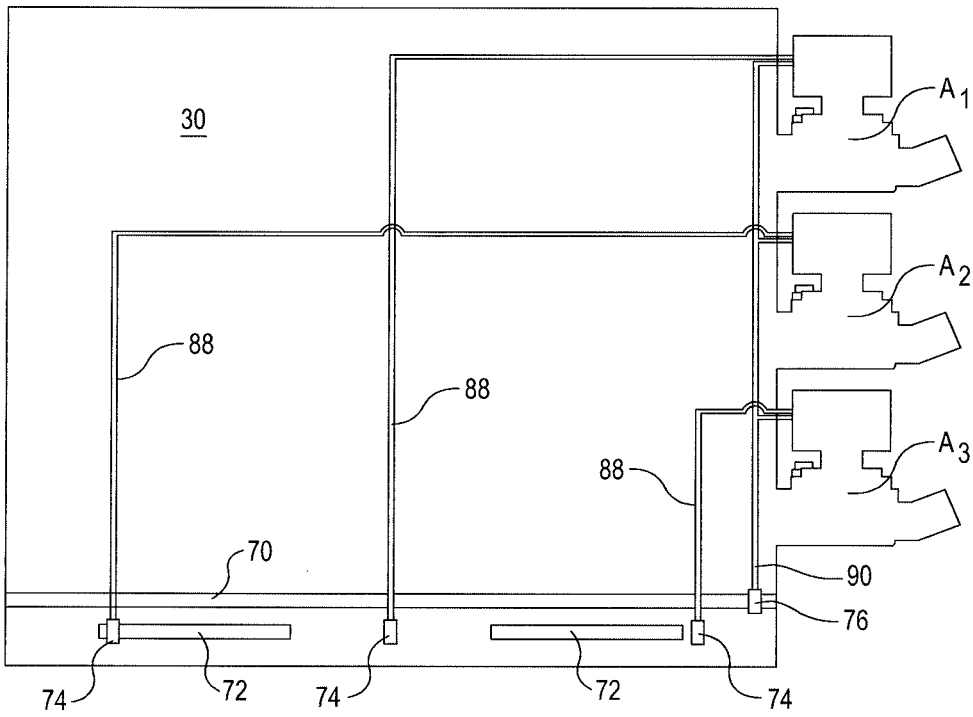
FIG. 6 provides a vertical pan view of an electrical system for use of a solenoid and slip ring arrangement for energizing and de-energizing a solenoid for opening and closing a valve in a sprinkler nozzle assembly; the view is taken as if the surface of the upper housing, and a portion of the base immediately there below, were rolled out flat, so that all of the circuits may be seen, as well as connections to the solenoid valves.
Figure 10:
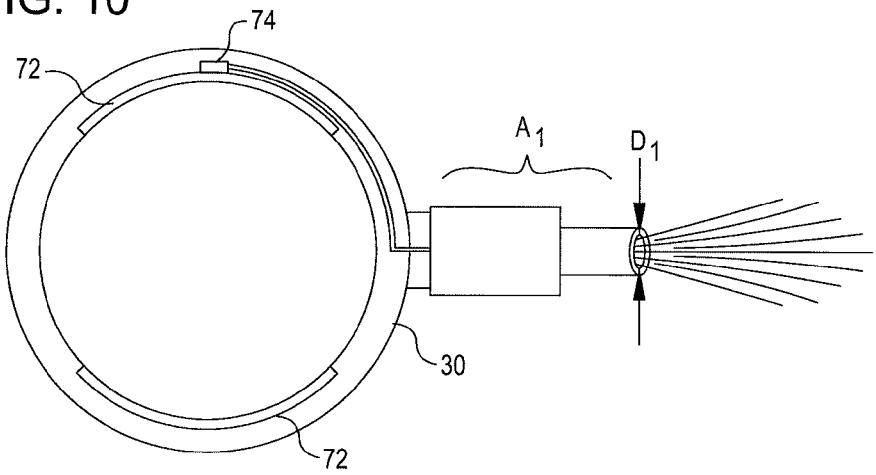
FIGS. 10, 11, and 12 provide diagrammatic views of the electrical system, to the extent interaction between a stationary contact and a slip ring turn a solenoid on at different locations during rotation.
Figure 11:
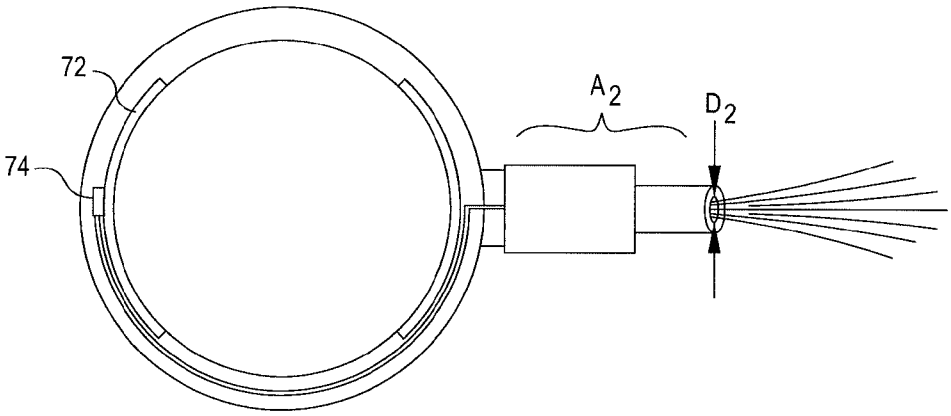
Figure 12:
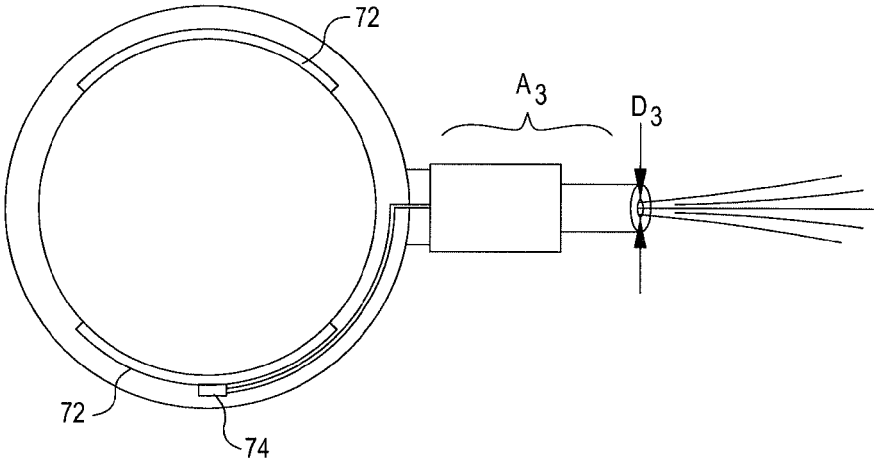

As seen in FIG. 1, a set of discontinuous slip ring contacts K is provided. The set of discontinuous slip rings 69 includes a ground ring 70 and powered segments 72 fixed on the base 28. The powered segments 72 are connected with a low voltage power source (not shown) for energizing the solenoid valves $S_1$, and the like. Each of the solenoids $S_1$ and the like have a hot, or powered contact 74 for intermittently receiving power from the discontinuous powered segments 72. Likewise, each of the solenoids S1 and the like have an electrical connection to ground contact 76 that slidingly interacts with the continuous ground ring 70, as the upper housing 30 is rotated. In an embodiment, a single ground contact 76 may be provided for all solenoids S on a sprinkler 22, or for all solenoids S in a group of solenoids. In any event, during rotation of the upper housing 30, the discontinuous slip ring 72 contacts turn said solenoid valve on when adjacent the powered segments 72, and off when not adjacent powered segments 72, to thereby control output of water from a particular nozzle N in a sprinkler valve assembly V, by turning off solenoid S. Powered 88 and ground 90 electrical lines are diagrammatically shown in FIG. 6. FIGS. 10, 11, and 12 schematically show the rotary electrical contact/non-contact situation, as viewed from above. These figures also show different nozzles N having outlets of differing diameter D, wherein different coverage distances may be obtained for watering.

Figure 8:
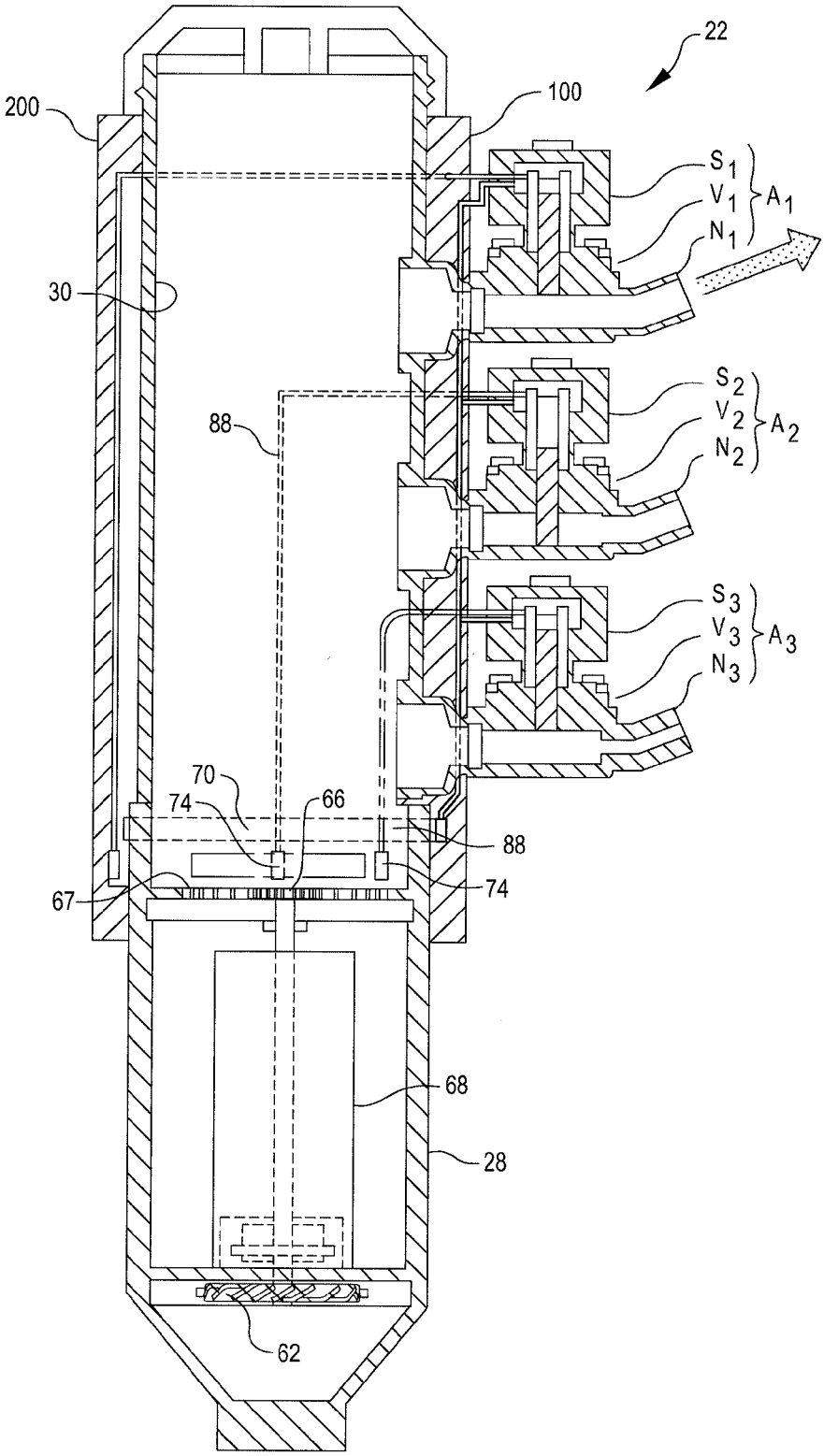
FIG. 8 provides a vertical cross-sectional view of an embodiment for a sprinkler having a upper housing rotatable by an impeller, showing the use of three solenoid valves, here showing the upper and the lower valves open, and the middle valve closed.
Figure 9:
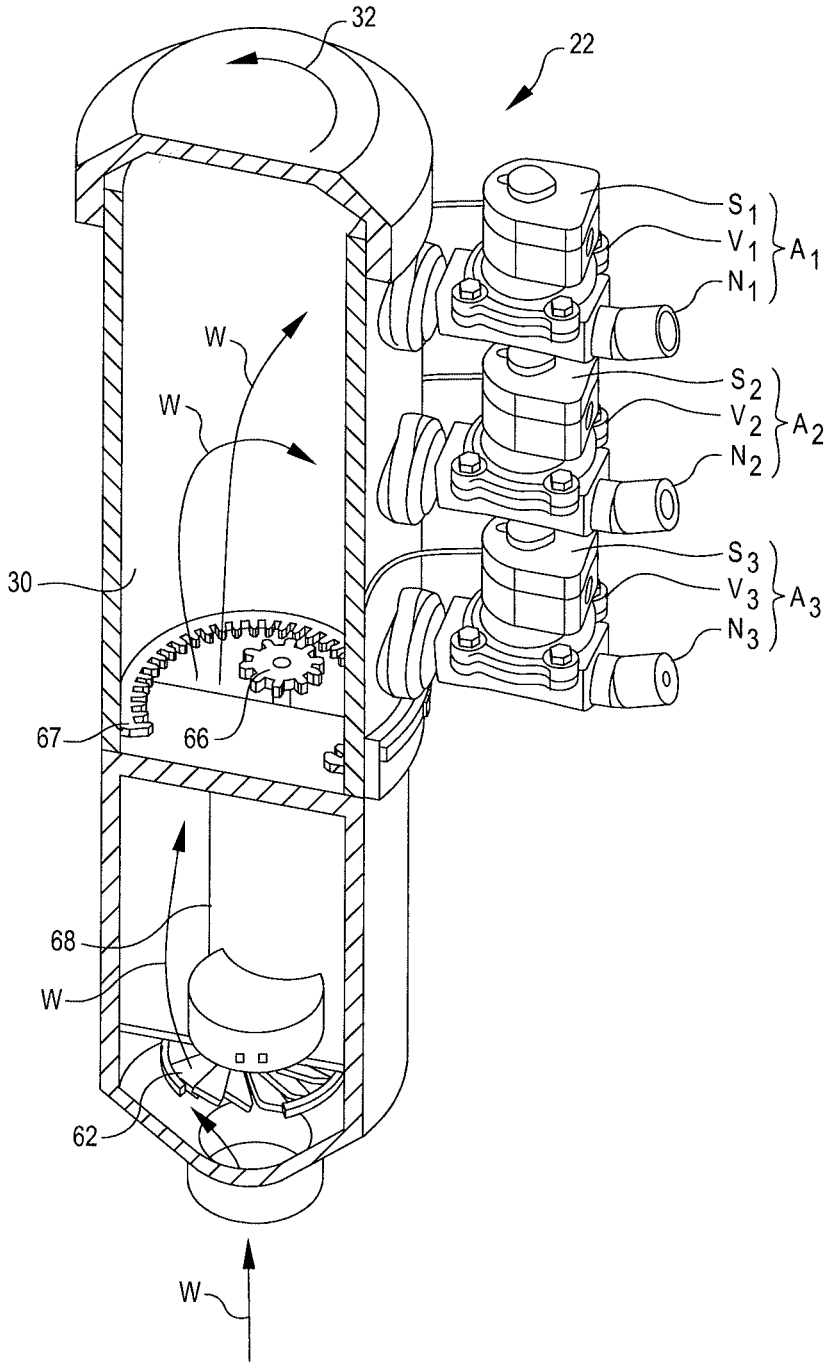
FIG. 9 provides a perspective of a vertical cross-sectional view of an embodiment for a lawn sprinkler for watering an irregular shaped lawn area, showing a plurality of sprinkler nozzle assemblies mounted on an upper housing, and showing annular gear for driving the upper housing, which annular gear is driven by a pinion gear, which in turn is driven by a shaft and gear train driven by a water turbine mounted at the inlet to the sprinkler.

In various embodiments, a plurality of sprinkler nozzle assemblies may be provided, and a solenoid valve V may be provided for each sprinkler nozzle assembly A. In an embodiment, as seen in FIG. 8, for example, the upper housing may have a first side 100, and a first group of sprinkler nozzle assemblies $A_1$, $A_2$, $A_3$, etc., are provided on the first side 100, each having a nozzle therein. In other embodiments, an upper housing may have a second side 200, where a second group of sprinkler nozzle assemblies (not shown), each including nozzles, may be provided. In various embodiments, the upper housing 30 may include X sides, wherein X is a positive integer, and a group of sprinkler nozzle assemblies may be provided on each of the X sides. As illustrated in FIG. 1, sprinkler nozzle assemblies A1, etc., in each group of sprinkler nozzle assemblies may be mounted in a vertical array, one above another. In various embodiments, the outlet diameter D of nozzles N in each group of sprinkler nozzle assemblies may vary between sprinkler nozzle assemblies in the vertical array.

It is to be appreciated that the various aspects, features, structures, and embodiments of a lawn sprinkler with flow regulator for substantially uniform delivery of water on a volume per square foot of lawn as described herein is a significant improvement in the state of the art. The lawn sprinkler design is simple, reliable, and easy to use. Although only a few exemplary aspects and embodiments have been described in detail, various details are sufficiently set forth in the drawing figures and in the specification provided herein to enable one of ordinary skill in the art to make and use the invention(s), which need not be further described by additional writing.

In the foregoing description, numerous details have been set forth in order to provide a thorough understanding of the disclosed exemplary embodiments for providing lawn sprinklers for watering irregularly shaped parcels. However, certain of the described details may not be required in order to provide useful embodiments, or to practice selected or other disclosed embodiments. Further, the description may include, for descriptive purposes, various relative terms such as surface, adjacent, proximity, near, on, onto, and the like. Such usage should not be construed as limiting. Terms that are relative only to a point of reference are not meant to be interpreted as absolute limitations, but are instead included in the foregoing description to facilitate understanding of the various aspects of the disclosed embodiments. Various items in the apparatus and in the method(s) described herein may have been described as multiple discrete items, in turn, in a manner that is most helpful in understanding such aspects and details. However, the order of description should not be construed as to imply that such items or sequence of operations are necessarily order dependent, or that it is imperative to fully complete one step before starting another. For example, the choice of where and how to mount a set of nozzles, or selection of outlet diameters of such nozzles, may be determined by a particular parcel to be watered, and may be different as regards installation particulars amongst various situations, for example, depending on water pressure available, and the amount of water desired to be directed to the parcel. Further, certain details of installation may not need to be performed in the precise or exact order of presentation herein. And, in different embodiments, one or more items may be performed simultaneously, or eliminated in part or in whole while other items may be added. Also, the reader will note that the phrase "an embodiment" has been used repeatedly. This phrase generally does not refer to the same embodiment; however, it may. Finally, the terms "comprising", "having" and "including" should be considered synonymous, unless the context dictates otherwise.

Various aspects and embodiments described and claimed herein may be modified from those shown without materially departing from the novel teachings and advantages provided by developments described herein, and may be embodied in other specific forms without departing from the spirit or essential characteristics thereof. Embodiments presented herein are to be considered in all respects as illustrative and not restrictive or limiting. This disclosure is intended to cover methods and apparatus described herein, and not only structural equivalents thereof, but also equivalent structures. Modifications and variations are possible in light of the above teachings. Therefore, the protection afforded to this invention should be limited only by the claims set forth herein, and the legal equivalents thereof.

The invention claimed is:

1. A sprinkler for watering a selected surface of a land parcel having a selected size and shape, said apparatus comprising:

a sprinkler base, said sprinkler base comprising a lower housing defined by a sprinkler base inner side wall, said sprinkler base comprising an inlet for receiving a pressurized water flow, an inlet turbine operably fixed in the base, a gear train having an output gear responsive to the inlet turbine;

an upper housing, said upper housing rotatably coupled to said sprinkler base, said upper housing driven by said output gear, said upper housing configured for receiving water from said base, said upper housing further comprising at least one sprinkler nozzle assembly, said at least one sprinkler nozzle assembly secured to and rotatable with the upper housing, the sprinkler nozzle assembly comprising a nozzle, a solenoid valve, and an outlet nozzle; and a set of discontinuous slip ring contacts, said set of discontinuous slip ring contacts including a ground ring and powered segments, said powered segments connected with a low voltage power source for energizing said solenoid valve, wherein during rotation of said upper housing, said discontinuous slip ring contacts turn said solenoid valve on when adjacent said powered segments, and off when not adjacent powered segments, to thereby control output of water from said nozzle.

2. The sprinkler as set forth in claim 1, wherein a plurality of sprinkler nozzle assemblies are provided, and wherein a solenoid valve V is provided for each sprinkler nozzle assembly A.

3. The sprinkler as set forth in claim 2, wherein said upper housing comprises at least a first side, and wherein a first group of nozzles are provided on the first side.

4. The sprinkler as set forth in claim 3, wherein said upper housing further comprises a second side, and wherein second group of nozzles are provided on the second side.

5. The sprinkler as set forth in claim 2, wherein said upper housing comprises X sides, wherein X is a positive integer, and wherein a group of sprinkler nozzle assemblies is provided on each of said X sides.

6. The sprinkler as set forth in claim 5, wherein each nozzle in said group of sprinkler nozzle assemblies is provided having a selected outlet diameter D, and wherein said selected outlet diameter D varies amongst nozzles in said group of sprinkler nozzle assemblies.

7. The sprinkler as set forth in claim 6, wherein sprinkler nozzle assemblies in each group of sprinkler nozzle assemblies are mounted in a vertical array, one above another.

8. The sprinkler as set forth in claim 7, wherein the outlet diameter D of nozzles in each group of sprinkler nozzle assemblies varies between sprinkler nozzle assemblies in each vertical array.

9. The sprinkler as set forth in claim 8, wherein the outlet diameter D in each group of sprinkler nozzle assemblies varies vertically.

10. The sprinkler as set forth in claim 9, wherein the outlet diameter D in each group of sprinkler nozzle assemblies decreases vertically in an upward direction.

11. The sprinkler as set forth in claim 9, wherein the outlet diameter D in each group of sprinkler nozzle assemblies decreases vertically in a downward direction.

12. The sprinkler as set forth in claim 1, wherein said upper housing further comprises an annular gear, and wherein said output gear drives said annular gear, rotating the upper housing.

13. The sprinkler as set forth in claim 1, wherein said discontinuous, powered portions of said slip rings are located at or near the top of said base.

14. The sprinkler as set forth in claim 13, wherein each of said solenoids is connected to a ground slip portion of ring at all times.

15. The sprinkler as set forth in claim 13, wherein each of said solenoids are connected to a contact that rotates with said upper housing, and provides connection to said discontinuous powered portions of said slip ring, when adjacent thereto.

16. The sprinkler as set forth in claim 15, wherein said at least one sprinkler nozzle assembly comprises a group of sprinkler nozzle assemblies, and wherein within said group, during rotation of the sprinkler, selected nozzle assemblies in said group intermittently turn on and off, as set up to meet water requirements of a land parcel.

17. The sprinkler as set forth in claim 16, wherein nozzles in said group of nozzle assemblies each have a diameter D, and wherein said a diameter D of each nozzle is sized and shaped to provide water quantities correlated to water delivery through its sprinkler nozzle assembly, for watering a surface of a land parcel having a selected size and shape.

18. The sprinkler as set forth in claim 17, wherein said nozzles N in said sprinkler each have nozzle diameters D selected to deliver water a selected range of radial distances R from said sprinkler, for watering a surface of a land parcel having a selected size and shape.

19. The sprinkler as set forth in claim 18, wherein said nozzles N in said sprinkler each have nozzle diameters D, which in co-operation with said sprinkler nozzle assembly and with said solenoids, deliver a selected volume of water along a selected radial for a radial distance R from said sprinkler, for watering a surface of a land parcel having a selected size and shape.

20. The sprinkler as set forth in claim 1, further comprising a generally cylindrical outer housing, said outer housing having an outer diameter OD approximately corresponding to the spacing between distal ends of nozzles in first and second groups of nozzles oriented at one hundred eighty degrees from each other.

* * * * *